United States Patent [19]

Falck

[11] Patent Number: 4,991,315

[45] Date of Patent: Feb. 12, 1991

[54] HORIZONTAL PELLET COOLER WITH IMPROVED SUPPORT TRAY

[75] Inventor: Glenn H. Falck, Montgomery, Pa.

[73] Assignee: Sprout-Bauer, Inc., Muncy, Pa.

[21] Appl. No.: 484,037

[22] Filed: Feb. 21, 1990

Related U.S. Application Data

[63] Continuation of Ser. No. 258,932, Oct. 17, 1988, abandoned.

[51] Int. Cl.[5] ..... F26D 7/00

[52] U.S. Cl. ..... 34/217; 34/236

[58] Field of Search ..... 34/20, 60, 203, 207, 34/206, 236, 217; 198/822, 851, 853; 432/239; 110/269, 270

[56] References Cited

U.S. PATENT DOCUMENTS 3,161,485 12/1964 Buhrer .

3,925,907 12/1975 Heinemann ..... 34/20

*Primary Examiner*—Henry A. Bennet

*Attorney, Agent, or Firm*—Richard H. Berneike

[57] ABSTRACT

A pellet cooler (10) includes an endless traveling grate conveyor (30), drive apparatus (34,36,40) operatively associated with the conveyor (30) for moving the conveyor in continuous travel about a continuous path, and a plurality of non-perforated material support trays (32) mounted to the conveyor in juxtaposed overlapping relationship to form a substantially continuous surface about the continuous path defined by the conveyor. Each of the material support trays comprises an elongated, laterally extending bi-lobed plate (50) having a first laterally extending outwardly projecting arcuate larger radius lobe (60) along one lateral extend thereof, a second laterally extending outwardly projecting arcuate smaller radius lobe (70) along the other lateral extent thereof, and a substantially flat laterally extending mid-portion (56) interconnecting the first lobe and the second lobe. The juxtaposed material support trays (32) are mounted to the conveyor with the first lobe (60) of one tray extending in overlapping spaced relationship concentrically over the second lobe (70) of the other of the juxtaposed material support trays thereby defining an air flow gap (80) therebetween.

3 Claims, 3 Drawing Sheets

HORIZONTAL PELLET COOLER WITH IMPROVED SUPPORT TRAY

This is a continuation of copending application Ser. No. 07/258,932 filed on Oct. 17, 1988, now abandoned.

BACKGROUND OF THE INVENTION

The present invention relates generally to apparatus adapted for use in transporting material through a heat exchange zone so as to bring the material in heat exchange contact with a heat exchange gas and, more particularly, to a substantially horizontal pellet cooler/dryer apparatus of the type employing an endless traveling grate conveyor wherein an improved support tray design is provided for carrying the pellets as they are conveyed through the heat transfer zone.

Applicant's assignee manufactures an apparatus, commonly known as a horizontal pellet cooler, wherein pellets of material such as animal food or other granular products are passed through a heat exchange zone on a endless traveling grate conveyor so as to contact the hot pellets received from the discharge of a pellet mill in contact with a cooling gas which is typically ambient air. An example of such a horizontal pellet cooler is presented in commonly assigned U.S. Pat. No. 4,344,524 of Glenn H. Flack and James R. Boose. As disclosed therein, the conventional horizontal pellet cooler generally consists of a housing defining a heat transfer chamber wherein there is positioned a substantially horizontally disposed endless traveling grate conveyor which may consist of one or more chains extending about a drive sprocket and an idler sprocket disposed in spaced relationship. A plurality of perforated metal carriers are mounted to the conveyor in juxtaposed relationship about the path of the conveyor chain to form an endless conveying belt having an upper surface which is used as the pellet carrying side, a descending turn-around end disposed about one sprocket, a substantially horizontal lower surface which serves as the return run, and an ascending turn-around portion disposed about the other sprocket. Hot, moist pellets are distributed on the perforated metal carriers forming the upper surface of the conveyor, and are cooled and dried as air is drawn through the perforations in the carrier tray as the pellets pass through the heat exchange chamber. The diameter of the perforations is selected to be smaller than the nominal size of the pellets being conveyed.

Recently, it has become a not uncommon practice in the production of animal feed pellets to spray coat the hot pellets discharged from the pellet mill with animal fat prior to passing same to the cooler. In the perforated tray type conveyors described hereinbefore, a problem has arisen in that the animal fat which has been sprayed on the hot pellets causes partial or complete blinding of the holes in the perforated trays. As a result, the air flow passing in heat exchange contact with the pellets as they traverse the cooler is reduced thereby resulting in improper cooling and increased maintenance to clean the trays.

One solution to the problem of the clogging of the air holes in such perforated trays with the animal fat is to provide solid, that is non-perforated, trays to carry the fat coated pellets through the heat exchanger of the pellet cooler. The use of such solid trays would reduce maintenance by eliminating the need to clean the fat clogged or partially blocked holes in the perforated trays. However, the use of solid trays presents the problem of insuring proper air flow through the pellets carried on the trays by providing appropriate gaps between adjacent trays while at the same time providing the air flow gaps in such a manner that the pellets do not fall through these large openings.

SUMMARY OF THE INVENTION

In accordance with the present invention, there is provided an apparatus adapted for use in transferring material through a heat exchange zone so as to bring the material in heat exchange contact with a heat exchange gas. The apparatus of the present invention is particularly suited to function as a pellet cooler wherein hot, moist, animal fat coated pellets are brought in heat exchange contact with ambient air as a cooling gas.

The apparatus of the present invention comprises an endless traveling grate conveyor means, drive means operatively associated with the conveyor means for moving the conveyor means in continuous travel about a continuous path, and a plurality of a material support trays mounted to the endless conveyor means in juxtaposed overlapping relationship to form a substantially continuous surface about the continuous path defined by the conveyor means. The endless traveling grate conveyor means has a substantially horizontal upper run onto which the material to be cooled and dried is fed, a descending turn-around end, a substantially horizontal lower return run, and an ascending turn-around end disposed in sequence so as to define the continuous path.

Each of the material support trays comprises an elongated, laterally extending bi-lobed plate having a first laterally extending outwardly projecting arcuate lobe along one lateral extend thereof, a second laterally extending outwardly projecting arcuate lobe along the other lateral extent thereof, and a substantially flat laterally extending mid-portion interconnecting the first lobe and the second lobe. The first lobe subscribes an arc of a circle of a first radius and the second lobe subscribes an arc of a circle of a second radius, with the first radius being greater than the second radius. The juxtaposed material support trays are mounted to the conveyor means with the first lobe of one tray extending in overlapping spaced relationship concentrically over the second lobe of the other of the juxtaposed material support trays thereby defining an air flow gap therebetween.

The endless traveling grate conveyor means comprises a chain conveyor having a continuous chain formed of a plurality of links adjoined in end-to-end relationship and wrapped in supporting relationship about a pair of spaced apart sprocket means which drive and guide the movement of the conveyor chain, one of the pair of sprocket means comprising a drive sprocket and the other an idler sprocket. Each of the chain links is pivotally pinned at its ends to the next preceding and the next trailing link in the continuous chain. The juxtaposed material support trays are preferably mounted to the conveyor means with the first tray mounted to the first of a pair of adjoining chain links and the second tray mounted to the second of the pair of adjoining chain links such that the first lobe of the first tray extends in overlapping spaced relationship concentrically over the smaller radius second lobe of the second of the juxtaposed trays. The centers of the first lobe of the first tray and the second lobe of the second tray coincide with the axis of the pivot pin joining the first and second chain links to which the first and second trays are respectively mounted. By mounting adjacent trays such that the pivot point in the pin adjoining sequential chain links coincides with the center of the radii of the first and second lobes respectively of the first tray and the second tray, the gap formed between the spaced apart concentric first and second lobes remains constant as the trays rotate around the sprocket means at the ascending and descending turn-around ends of the conveyor. The overlapping of the first and second lobes of adjacent trays in concentric relationship provides a constant gap so that a consistent air velocity is maintained about the entire continuous path defined by the conveyor means. By maintaining the gap constant as the chain and the trays mounted thereto pass around the sprockets of the ascending and descending turn-around ends of the conveyor, the possibility of product falling inside the conveyor through the air passages formed by the overlapping lobes of adjoining trays is greatly reduced.

BRIEF DESCRIPTION OF THE DRAWINGS

A more complete understanding of the present invention may be had from the following description of a preferred embodiment thereof wherein reference is made to the accompanying drawings, in which.

DESCRIPTION OF A PREFERRED EMBODIMENT

Figure 1:
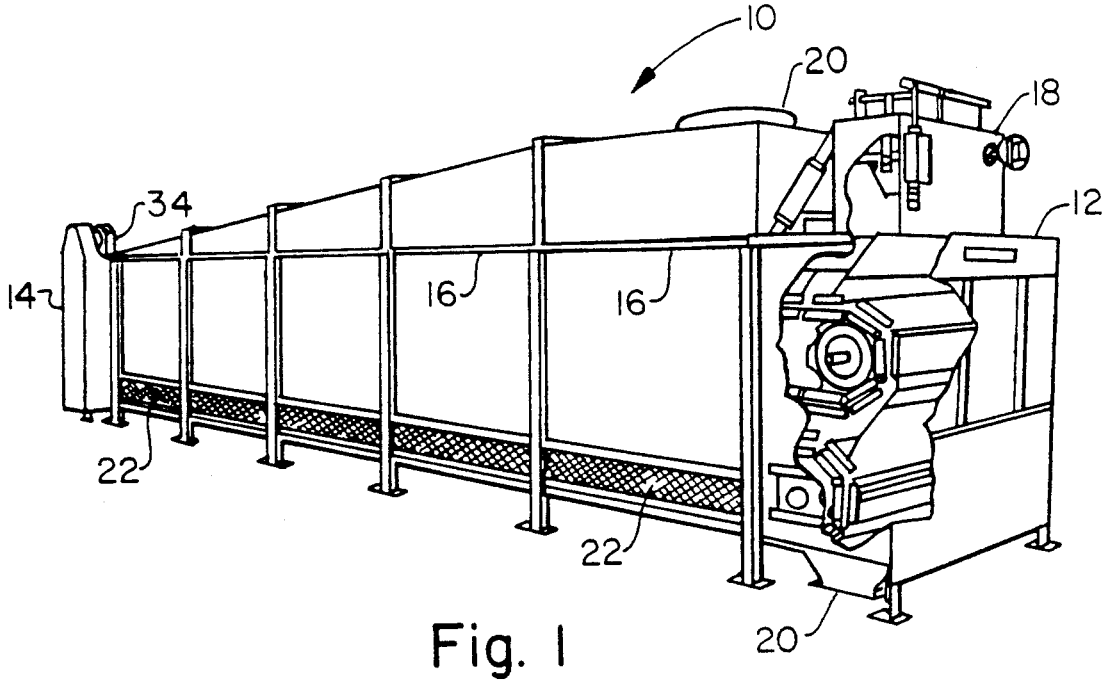
FIG. 1 is a perspective view, partly broken away, of an apparatus adapted in accordance with the present invention for use as a pellet cooler for transporting pellet material through a cooling heat exchange zone.
Figure 2:
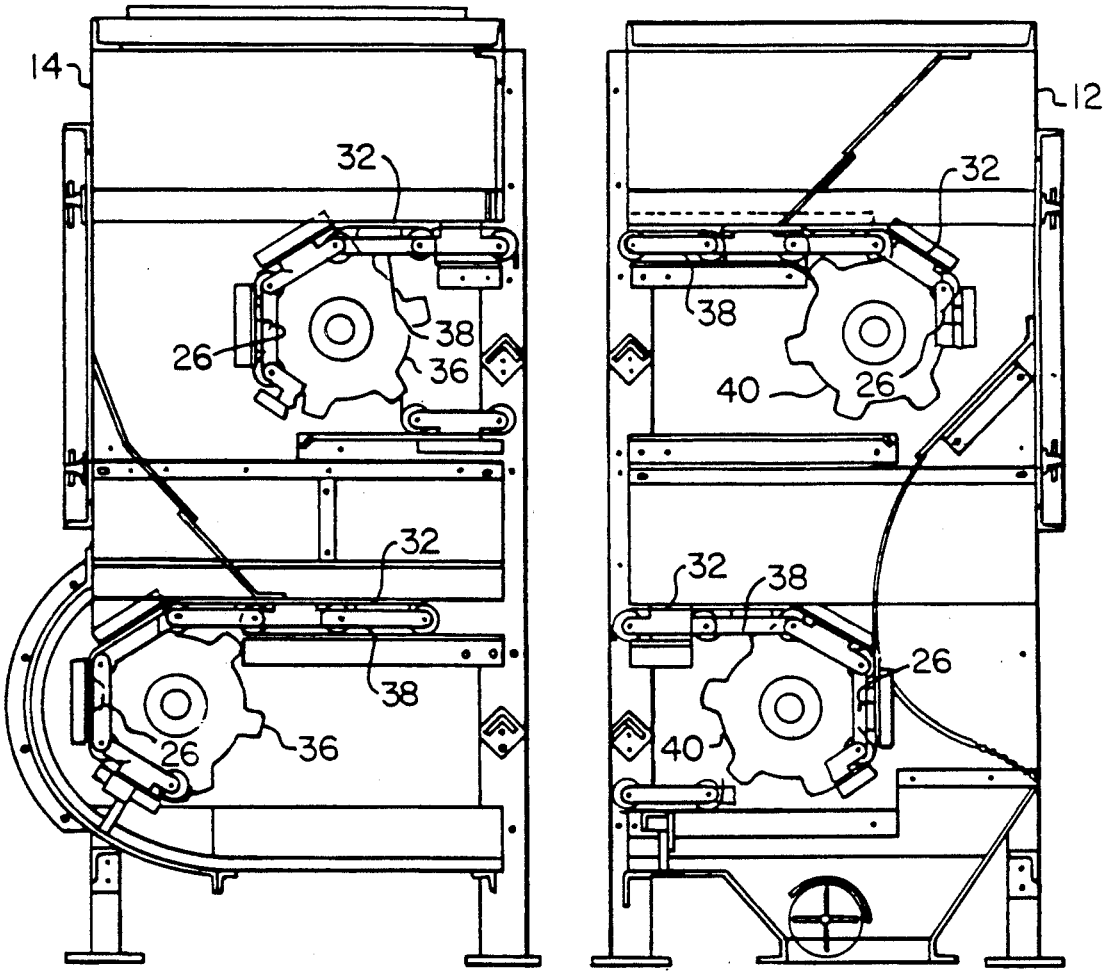
FIG. 2 is a side elevational interior view of the inlet end and the tail end section of the apparatus of FIG. 1.

Referring now to FIGS. 1 and 2, there is depicted therein a horizontal, or substantially horizontal, pellet cooler 10 which comprises an apparatus adapted for use in transporting pellets through a cooling zone so as to bring the pellets in heat exchange contact with ambient cooling air. The apparatus of the present invention will be described in the discussion hereinafter with reference to the drawings in the embodiment of the horizontal pellet cooler. It is to be understood, however, that the present invention may be utilized for cooling or heating material whether that material is in the form of pellets or other discreet forms so long as the material is transported through a heat exchange zone so as to bring the material in heat exchange contact with a heat exchange gas.

The pellet cooler 10 generally comprises an inlet section 12, a tail end section or drive section 14, and one or more modular designed, intermediate cooling sections 16 of a sufficient number to provide the desired pellet cooling length. The pellet cooler 10 may be either a double pass unit, as shown, or a single pass unit (not shown). In the double pass or double conveyor unit as shown, the inlet or inlet hopper is at 18 and the discharge or discharge hopper is at the same end of the cooler at 20. In the single type pass cooler, on the other hand, the pellets are admitted through an inlet at one end and discharged through an outlet at the opposite end. For cooling the pellet material, in either case, air is drawn into the unit 10 through grills 22 by means of a fan operatively connected to duct 24 and is drawn through the bed or beds of pellet material built upon and being conveyed upon the surface of the endless traveling grate conveyor or conveyors disposed within the housing of the pellet cooler 10.

Figure 3:
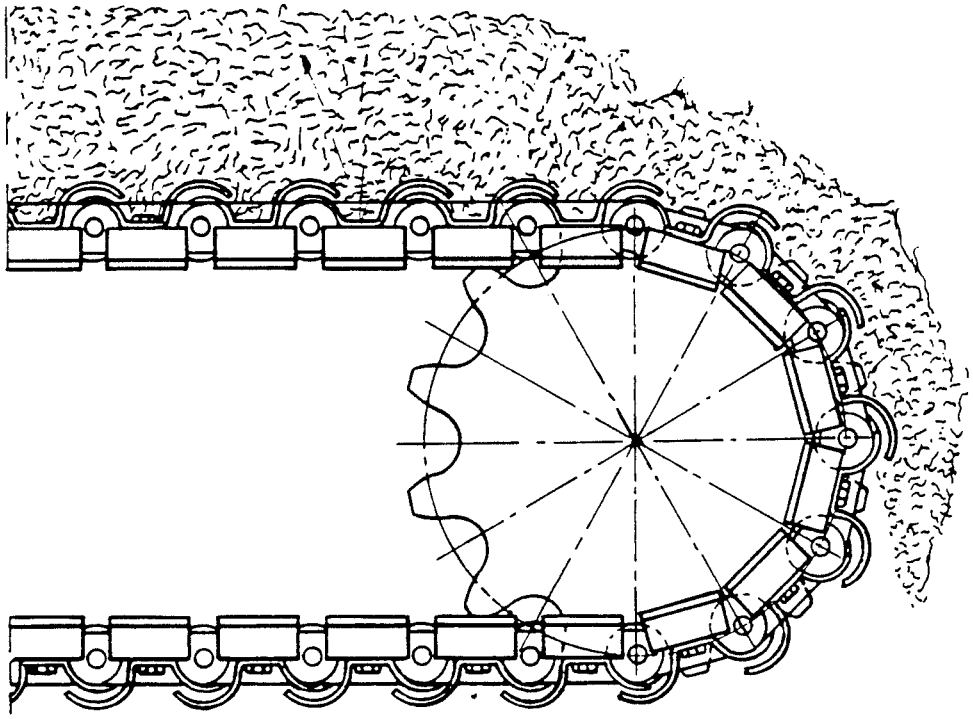
FIG. 3 is an elevational view of a section of the conveyor means showing a plurality of material support trays of the present invention mounted thereto in accordance with the present invention as the conveyor means about the turn around end of the lower conveyor at the outlet section of the pellet cooler of FIG. 1.

In the operation of a horizontal pellet cooler 10, a variable speed drive motor 34 (FIG. 1) drives a pair or pairs of laterally spaced drive sprockets 36, and through chains 38 entrained thereabout and about the front end idler sprockets 40 longitudinally spaced from the drive sprockets 36, thereby providing slow-moving carrier power for conveying the material support trays 32 through the pellet cooler. Hot, moist pellets are distributed in a uniform bed death on the upper surface of the material support plates of the upper endless traveling grate conveyor at the inlet end 12 of the pellet coolers. The pellets are then transported through the upper stage of the pellet cooler and are discharged from the upper conveyor onto the upper surface of the material support trays 32 of the lower conveyor as the material support trays 32 of the upper conveyor traverse the descending path taken by the upper conveyor means as it passes around the upper drive sprocket 36. The pellets discharged from the upper conveyor fall onto the lower conveyor and again collect in a uniform bed and are thence conveyed on the material support trays 32 of the lower conveyor back to the inlet section 12 of the pellet cooler where they are discharged from the material support trays 32 of the lower conveyor as they traverse the descending path of the lower idler sprocket 40 of the lower conveyor means. As illustrated in FIG. 3, the dried and cooled pellets fall from the material support trays 32 of the lower conveyor through the discharge outlet 20 formed in the hopper section of the inlet end 12 of the pellet cooler. The hot, moist pellets which are distributed onto the upper conveyor means in a uniform bed are cooled and dried as they pass through the pellet cooler by air drawn upwardly through the conveyor means to pass in heat exchange contact with the pellets. After a sufficient retention time, which is a function of conveyor speed in the length of the cooler, the dried and cooled pellets are discharged.

In a pellet cooler such as that described in U.S. Pat. No. 4,344,524, wherein the material support plates are perforated, the cool ambient air being drawn through the pellet cooler in order to cool the pellets being carried on the trays passes through the openings or perforations formed in the material support trays. Therefore, in such a system it is desired that adjacent material support trays are disposed such that there is no gap or at least a very minimal gap between juxtaposed material support trays on the conveyor means. However, when as in the present invention, a solid non-perforated plate is being utilized as a material support tray, juxtaposed material support trays must be positioned such that an air flow gap is formed at the interface between each set of juxtaposed material support plates.

Figure 4:
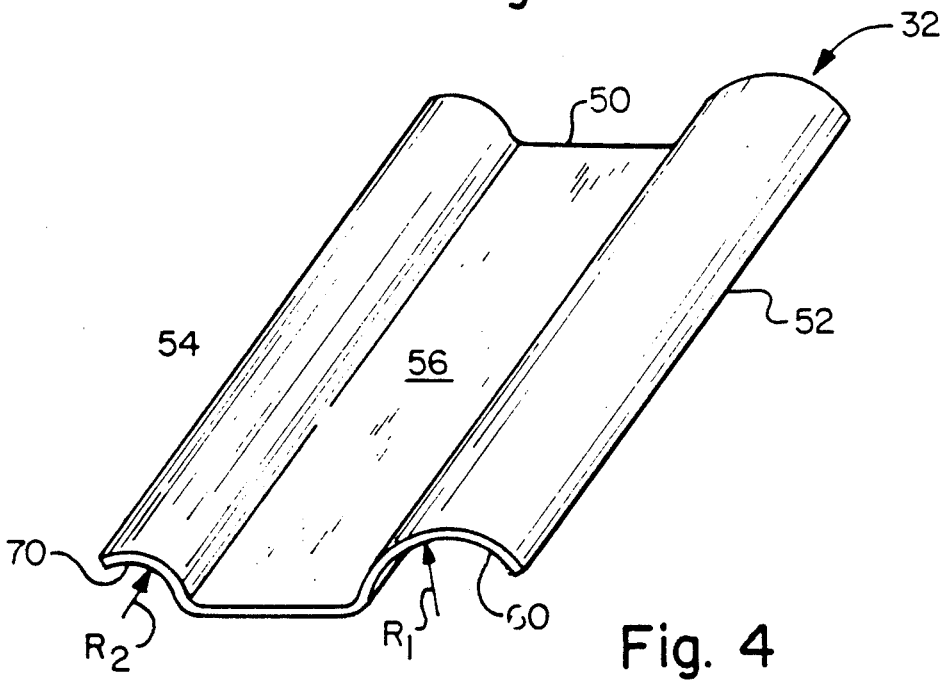
FIG. 4 is a perspective view of the material support tray of the present invention.

As best seen in FIG. 4, the material support tray 32 of the present invention comprises an elongated, laterally extending bi-lobed plate 50 having a first laterally extending outwardly projecting arcuate lobe 60 extending along one lateral extent 52 of the plate 50 and a second laterally extending outwardly projecting arcuate lobe 70 extending along the other lateral extent 54 of the plate 50, and a substantially flat laterally extending mid-portion 56 interconnecting the first lobe 60 and the second lobe 70. The first lobe 60 subscribes an arc of a circle having a first radius $R_1$, while the second lobe subscribes an arc of a smaller circle of a second radius, $R_2$. The first radius $R_1$ is greater than the second radius $R_2$ by a predetermined amount which will determine the cross-dimension of the air gap 80 formed between overlapping trays 32 when mounted to the conveyor means in accordance with the present invention.

Figure 5:
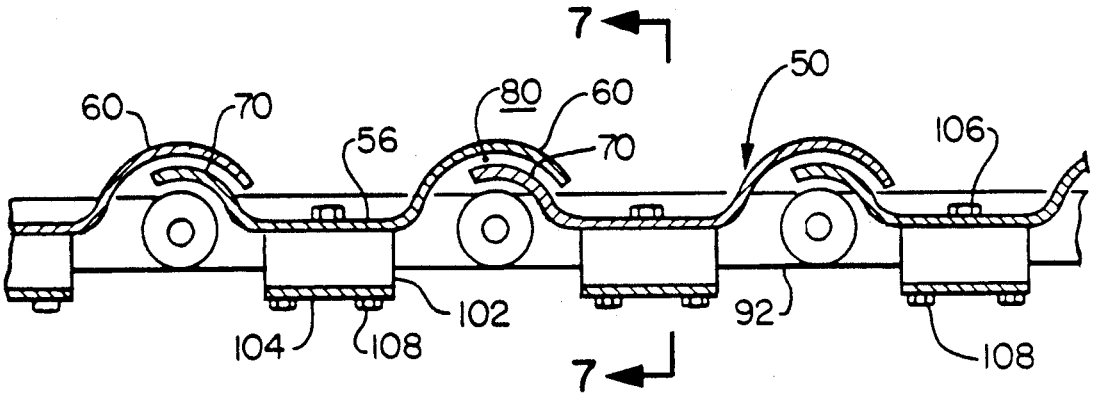
FIG. 5 is an elevational view of a section of the conveyor means showing a plurality of material support trays mounted thereto with one tray per chain link.
Figure 6:
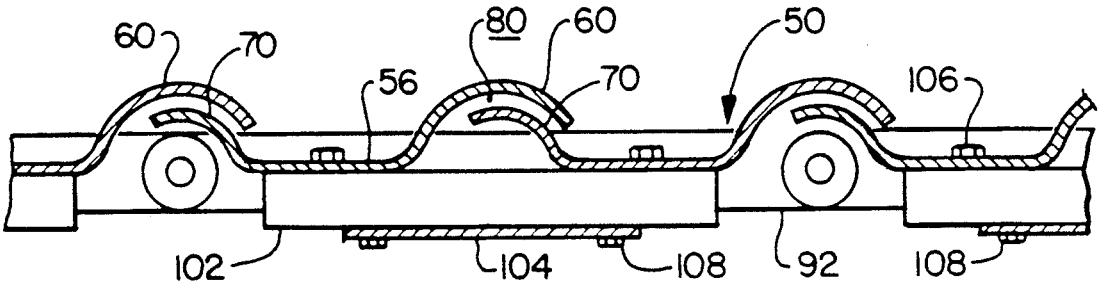
FIG. 6 is an elevational view of a section of the conveyor means showing a plurality of material support trays mounted thereto with two trays per chain link.

The pellet cooler of the present invention, comprises an endless traveling grate conveyor means 30, drive means operatively associated with the conveyor means 30, and a plurality of the material support trays 32 of the present invention as hereinbefore described mounted to the endless conveyor means 30 in juxtaposed overlapping position as shown in FIGS. 5 and 6. The endless traveling grate conveyor means 30 has a substantially horizontal upper load run, a descending turn-around end about one sprocket, a substantially horizontal lower return run, and an ascending turn-around end about the other sprocket disposed in sequence so as to define a continuous path. The drive means, which comprises motor means 34 and its associated gearing and drive belts (not shown) move the conveyor means 30 in continuous travel about the continuous path defined by the conveyor means. The material support trays 32 of the present invention are mounted to the endless conveyor to form a substantially continuous surface about the continuous path defined by the endless conveyor means 30. The substantially continuous surface defined by the plurality of juxtaposed overlapping material support trays 32 of the present invention form the surface upon which the hot, moist pellets are deposited.

With respect to each set of juxtaposed overlapping material support trays 32, the first lobe 60, i.e., the larger radius lobe, of one tray 32 extends an overlapping spaced relationship concentrically over the second lobe 70, i.e., the smaller radius lobe, of the other of the juxtaposed material support trays 32 making up the set of adjacent trays. In this manner, a uniform air flow gap 80 is provided between the overlapping lobes of adjacent plates such that air may pass upwardly through the conveyor means by passing through the gaps 80 between overlapping lobes of adjacent trays into the bed of pelletized material being carried on the upper surface of the material support trays 32.

The endless traveling grate conveyor means 30 comprises a chain conveyor comprising a pair of laterally spaced claims 90. Each continuous chain 90 is formed of a plurality of links 92 joined in end-to-end relationship and is wrapped in supporting relationship about the spaced apart drive sprocket 36 and the idler sprocket 40. Each of the chain links 92 are pivotally pinned at their ends to the next preceding and next traveling link to form the continuous chain 90. The pivot pin 94 passes through the ends of the adjoining chains and extends along an axis 96 which is disposed transverse to the continuous chain 90. One or more material support trays are mounted to each chain link 92 as illustrated in FIGS. 5 and 6, respectively.

When the juxtaposed material support trays 32 are mounted to the conveyor means 30 with the first tray of each set of juxtaposed material support trays 32 mounted to the first of a pair of adjoining chain links 92 and the second tray mounted to the second of a pair of adjoining chain links 92 such that the first lobe 60, i.e., the larger radius lobe of the first tray 32 of the set, extends in overlapping spaced relationship concentrically over the second lobe 70, i.e., the smaller radius lobe, of the second of the juxtaposed trays 32 with the center of the concentric first lobe 70 of the first tray and the second lobe 60 of the second tray coinciding with the axis 96 of the pivot pin 94 joining the first and second adjoining chain links 92. By assembling the plurality of material support trays 32 in juxtaposed relationship such that the centers of the overlapping lobes are concentric and coincide with the axis of the pivot pin of adjoining links to which each set of juxtaposed material support trays are mounted, it is assured that the gap 80 formed between the overlapping lobes 60 and 70 of juxtaposed material support trays will remain uniform and of constant dimension as the material support trays traverse the entire continuous path defined by the conveyor including the ascending and descending turn-around ends of the conveyor means 30. Accordingly, the gap does not widen as in prior art designs as the trays move around the ascending and descending ends. Therefore, air flow remains uniformly distributed as it passes through the gaps in the conveyor means 30 as all gaps 80 remain uniform and of constant dimension. Additionally, the material cannot pass through the gaps due to their overlapping relationship as the trays begin their descent around the descending turn-around end of the conveyor means 30.

It is to be understood that the conveyor means 30 of the present invention may utilize a single continuous chain disposed about a single drive sprocket and a single idler sprocket spaced therefrom. Preferably, however, the conveyor means 30 comprises a pair of continuous chains disposed in parallel relationship about a pair of laterally spaced operatively interconnected sprockets which collectively comprise the drive sprocket means 36 and a pair of corresponding laterally spaced operatively connected sprouts which collectively comprise the idler sprocket means 40 longitudinally spaced from the drive sprockets. In the case of a single drive chain mechanism, each material support plate 32 is mounted thereto with the continuous chain 90 being centrally disposed beneath the material support plates 32 so that when pellets are deposited on the material support plates the material support plates will be balanced with their centroid above the single continuous chain 90.

Figure 7:
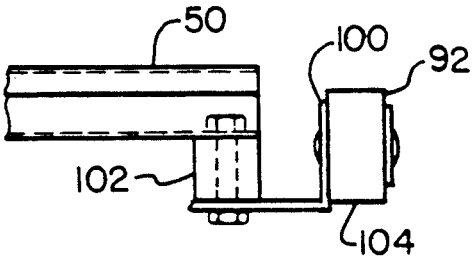
FIG. 7 is a sectional view taken along line 7—7 of FIG. 5.

In the case of a double chain conveyor, the material support plates are mounted to the conveyor means, as shown in FIG. 7, such that one chain is disposed along one lateral edge of the material support trays 32 and the other chain is laterally spaced therefrom and extends along the other lateral edge of the material support plates 32. In such a double chain conveyor, when the pellets are deposited upon the material support trays, the centroid of the loaded material support plates will fall essentially mid-way between the spaced apart chain whereby the weight of the loaded plates is evenly distributed between the two parallel chains. As best seen in FIG. 6, each material support tray 32 is mounted along each of its laterally spaced edges to a link 92 of the chain passing therealong by mounting means 100 comprising support bar 102, mounting bracket 104, and appropriate fastening means, such as bolts 106 and 108. Each material support tray 32 is secured by bolts 106 along each lateral edge to a support bar 102 extending therebeneath. Each support bar 102 is in turn secured by bolts 108 to an angular mounting bracket 104 which is mounted to a laterally adjacent link 92 of the conveyor chain 90 by bolting or other means.

In either case, the material support trays are mounted to the conveyor means 30, be it a single chain conveyor or a double chain conveyor, in the manner hereinbefore described such that the centers of the overlapping larger lobe 60 of the first tray of a set of juxtaposed trays and the smaller radius lobe 70 of the second tray of the set of juxtaposed trays are concentrically disposed with their centers coinciding with the axis 96 of the adjoining chain links 92 to which the first and second trays of the set of juxtaposed trays are mounted.

I claim:

1. A pellet cooling apparatus for use in transporting hot, moist pellets through a heat exchange zone so as to bring the pellets in heat exchange contact with a cooling gas, comprising:

a. an endless traveling grate conveyor means having a substantially horizontal upper run, a descending turn-around end, a substantially horizontal lower run, and an ascending turn-around end disposed in sequence so as to define a continuous path;

b. housing means disposed about and enclosing said conveyor means, said housing means having an inlet through which pellets to be cooled may be deposited unto said conveyor means and an outlet through which cooled pellets may be discharged from said conveyor means;

c. drive means operatively associated with said conveyor means for moving said conveyor means in continuous travel about the continuous path within said housing;

d. a plurality of non-perforated material support trays mounted to said endless conveyor means in juxtaposed overlapping relationship to form a substantially continuous surface about the continuous path defined by said endless conveyor means, each of said material support trays comprising an elongated, laterally extending bi-lobed plate having a first laterally extending outwardly projecting arcuate lobe along one lateral extent thereof, a second laterally extending outwardly projecting arcuate lobe along the other lateral extent thereof, and a substantially flat laterally extending mid-portion interconnecting said first lobe and said second lobe, said first lobe subscribing an arc of a circle of a first radius and said second lobe subscribing an arc of a circle of a second radius, said first radius being greater than said second radius, said juxtaposed material support trays disposed with the first lobe of one tray extending in overlapping spaced relationship concentrically over the second lobe of the other of said juxtaposed material support trays so as to define a cooling gas passageway therebetween; and e. fan means operatively associated with said housing means for causing cooling gas to pass into said housing means, thence through the cooling gas passageways of said conveyor means and through the pellets deposited unto said conveyor means.

2. Apparatus as recited in claim 1 wherein said endless traveling grate conveyor means comprises a chain conveyor having a continuous chain formed of a plurality of links adjoined in end-to-end relationship and wrapped in supporting relationship about a pair of spaced sprocket means, one of said pair of sprocket means comprising a drive sprocket driven by said drive means and the other of said pair of sprocket means comprising an idler sprocket means, each of said chain links pivotally pinned at its ends to the next preceding and the next traveling link in said continuous chain.

3. Apparatus as recited in claim 2 wherein said juxtaposed material support trays are mounted to said conveyor means with the first tray mounted to the first of a pair of adjoining chain links and the second tray mounted to the second of the pair of adjoining chain links such that the first lobe of the first tray extending in overlapping spaced relationship concentrically over the second lobe of the second of said juxtaposed trays and the center of said concentric first lobe of the first tray and second lobe of the second tray coincides with the axis of the pivot pin joining the first and second adjoining chain links.

* * * * *